United States Patent [19]

Stark et al.

[11] 4,427,724

[45] Jan. 24, 1984

[54] NOVELTY DEVICE

[75] Inventors: Martin H. Stark, Saginaw; George V. Pisani, Bloomfield Hills; James J. Pauquette, Saginaw, all of Mich.

[73] Assignee: Arrow Paper Products Co., Saginaw, Mich.

[21] Appl. No.: 426,790

[22] Filed: Sep. 29, 1982

[51] Int. Cl.[3] ..... A41G 1/04; D04D 1/00

[52] U.S. Cl. ..... 428/7; 116/173; 428/10; 428/542.4

[58] Field of Search ..... 428/18, 4, 7, 10, 18, 428/23, 542.4, 542.2; 116/173

[56] References Cited

U.S. PATENT DOCUMENTS

| | | | |
|---|---|---|---|
| 1,047,703 | 12/1912 | Rapson | 428/4 X |
| 2,968,890 | 1/1961 | DeNisco | 428/7 X |
| 3,003,623 | 10/1961 | Paul et al. | 428/18 X |
| 3,130,898 | 4/1964 | Raamat | D25/78 X |
| 3,457,134 | 7/1969 | Karkoska | 428/23 X |
| 3,589,970 | 6/1971 | Polly | 428/18 X |
| 4,055,840 | 10/1977 | Uchytil et al. | 428/4 X |
| 4,201,806 | 5/1980 | Cole | 428/4 |
| 4,369,215 | 1/1983 | Offen et al. | 428/4 |

*Primary Examiner*—Henry F. Epstein
*Attorney, Agent, or Firm*—Learman & McCulloch

[57] ABSTRACT

A novelty device has a tubular body into one end of which extends a flexible member. That end of the flexible member accommodated within the tubular body is secured to an anchor member. The anchor member is retained in the tubular body by retaining lips formed at the one end of the body and which extend toward one another so as to prevent passage of the anchor member outwardly of the tubular body.

8 Claims, 5 Drawing Figures

NOVELTY DEVICE

BACKGROUND OF THE INVENTION

It is common practice for spectators at athletic events to wave devices such as pennants, pom-poms, towels, and the like as a display of enthusiam for one or another of the contestants. Some of such devices are unwiedly because of their size, whereas others, such as pennants on sticks, present the possibility of injury to spectators.

Among the objects of the present invention are to provide a device of a character referred to and which is safe to use, capable of compact storage when not in use, and lends itself to the incorporation of the colors of a contestant.

SUMMARY OF THE INVENTION

A device according to the invention comprises an elongate body that is hollow at least at one end thereof so as to provide at such one end a cavity. Extending into such cavity is one end of an elongate, flexible member having a core to which short streamers are secured. That end of the flexible member which extends into the cavity is provided with an anchor member that is retained within the cavity, whereby that portion of the flexible member which extends outwardly of the cavity may be waved back and forth. The body member preferably is formed of deformable material so that such material at the free end of the cavity may be deformed inwardly and react with the anchor member to retain the latter within the cavity. The deformability of the body material, coupled with the flexibility of the flexible member, enables the flexible member to be stored wholly within the cavity when the device is not in use.

DESCRIPTION OF THE DRAWINGS

A device constructed according to the preferred embodiment of the invention is illustrated in the accompanying drawings, wherein.

DESCRIPTION OF THE PREFERRED EMBODIMENT

Figures 1, 2, 3, 4, 5:
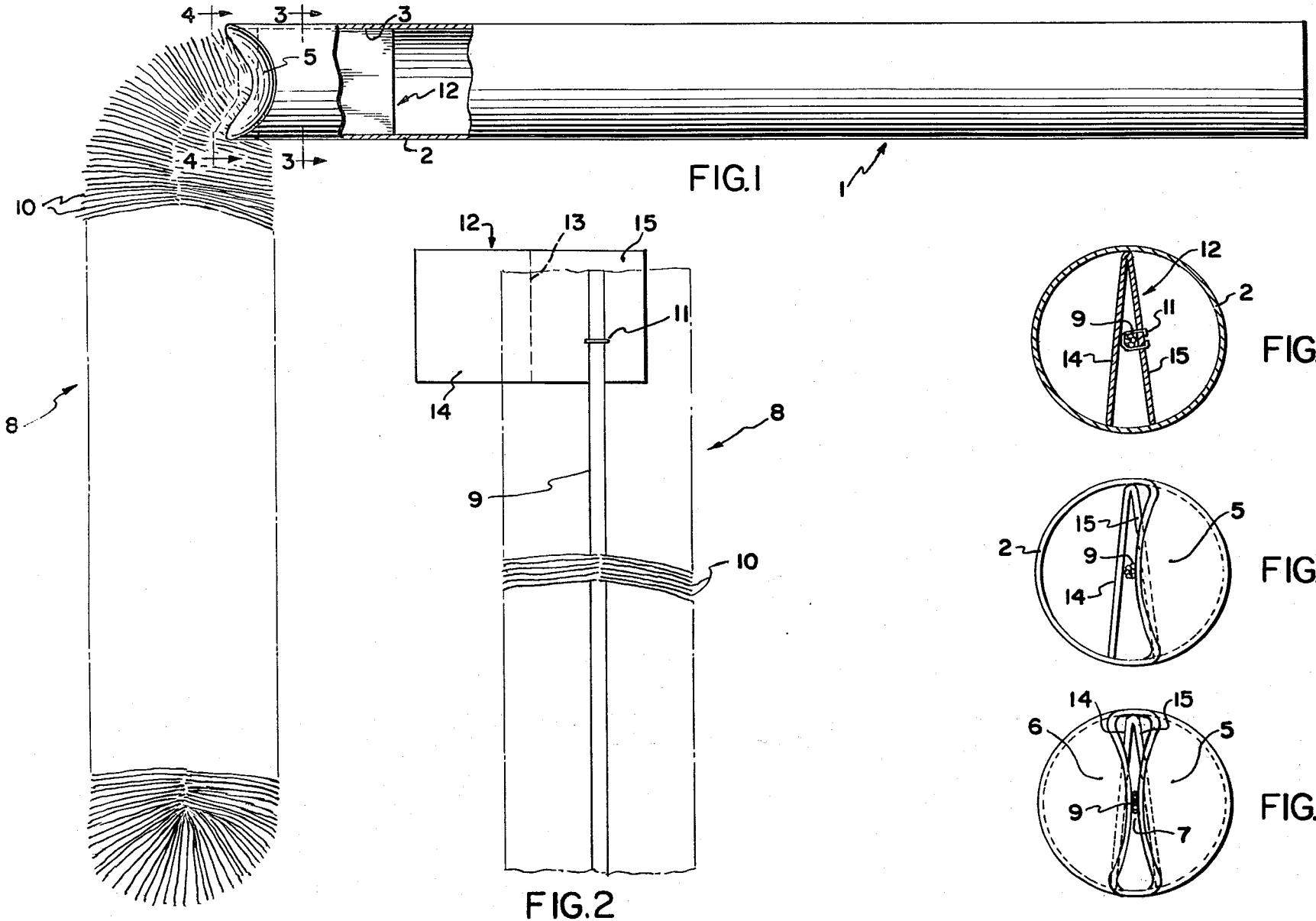
FIG. 1 is an elevational view, partly in section of the device.
FIG. 2 is a fragmentary, plan view of a portion of the device.
FIG. 3 is a sectional view taken on the line 3—3 of FIG. 1.
FIG. 4 is a sectional view taken on the line 4—4 of FIG. 1 and illustrating an intermediate step in the assembly of the parts of the device.
FIG. 5 is a view similar to FIG. 4, but illustrating the parts in their final assembly positions.

The device constructed in accordance with the preferred embodiment of the invention comprises an elongate body 1 preferably constituting a spirally or convolutely wound tube having a cylindrical wall 2 formed of deformable material such as paper. Although it is preferred that the body 1 be hollow, it is only necessary that one end of the body be hollow so as to define at such end a cavity 3.

At the end of the body adjacent the cavity 3 two opposed portions of the body wall 2 are deformed inwardly toward each other so as to from a pair of arcuately indented retaining lips 5 and 6 having their free edges confronting one another and defining a reduced area opening or passageway 7 therebetween. The retaining lips 5 and 6 may be formed in the manner disclosed in Raamat U.S. Pat. No. 3,130,898 or in any other suitable manner.

Also forming part of the device is an elongate, flexible member 8 comprising a core or cord 9 of braided wires or the like and which support and retain a large number of relatively short streamers 10 formed of paper, textile, or plastic material. The streamers 10 project transversely of the core 9 and extend completely circumferentially of the latter so that the core is relatively invisible.

One end of the core 9 is secured by a staple 11 or the like to an anchor member 12 which comprises a rectangular, stiff but deformable sheet of cardboard or the like which may be folded about a center line 13 to form two substantially parallel limbs 14 and 15. The width of each limb preferably corresponds substantially to the inside diameter of the body 1 so that the folded anchor member may be inserted into the cavity 3. Preferably, the member 8 is secured by a staple 11, or in any other suitable way, to the anchor member 12 about midway between the side edges of the limb 15 so that, when the anchor member is fitted into the cavity 3, the core 9 will emerge from the cavity at about the center of the tube, as is best shown in FIGS. 3–5.

To assemble the members 1, 8, and 12, the core 9 of the member 8 is first secured to the member 12 in the manner described, following which the retaining lips 5 and 6 at the free end of the cavity 3 are spread apart so as to enable the folded member 12 to be fitted into the cavity a distance sufficient to locate the member 12 inwardly of the outer end of the cavity. Thereafter, the retaining lips 5 and 6 may be pressed inwardly so as to grip the core 9, as is best shown in FIG. 5, and the core will cause the limbs 14 and 15 to diverge from the fold line 13 so as to have a transverse dimension greater than the maximum width of the passageway 7. The retaining lips thus form barriers to the passage of the anchor member 12 outwardly of the cavity. The gripping of the core 9 by the opposed retaining lips 5 and 6 also prevents movement of the anchor member 12 inwardly of the body 1 towards its opposite end.

The exterior of the body 1 may be decorated with the colors of a competitor in an athletic event and the individual strands 10 of the member 8 may be similarly colored.

When the device is not in use the lips 5 and 6 may be spread and the member 8 wholly accommodated within the body.

This disclosure is representative of a presently preferred embodiment of the invention but is intended to be illustrative rather than definitive thereof. The invention is defined in the claims.

I claim:

1. A novelty device comprising a body open at one end and having a cavity at least at said one end; an elongate, flexible member having one end thereof accommodated in said cavity and the remainder thereof being outward of said body, said flexible member comprising a core and a plurality of streamers fixed to and extending transversely of said core; anchor means accommodated in said cavity; means securing said anchor means to said one of said flexible member; and retaining means reacting between said body at said one end thereof and said anchor means and retaining the latter and said one end of said flexible member within said cavity.

2. A device according to claim 1 wherein said body is formed of deformable material and wherein said body at said one end thereof is deformed to reduce the cross-sectional area of said opening at said one end of said body.

3. A device according to claim 2 wherein said anchor member is of such size as to be incapable of passing through said opening at said one end of said body.

4. A device according to claim 1 wherein said anchor member is composed of deformable material.

5. A device according to claim 4 wherein said anchor member comprises a substantially flat element bent between its ends.

6. A device according to claim 5 wherein said flat element is bent to form a pair of substantially parallel limbs.

7. A device according to claim 6 wherein as least one of said limbs has a length at least as great as the transverse width of said cavity at its widest zone.

8. A device according to claim 7 wherein said flexible member is secured to said one limb substantially midway between the ends of the latter.

* * * * *